United States Patent [19]

Lopez

[11] Patent Number: 4,785,912

[45] Date of Patent: Nov. 22, 1988

[54] FOLDING LADDER

[76] Inventor: José A. Lopez, 2317 Pinnacle Dr., Martinez, Calif. 94553

[21] Appl. No.: 133,597

[22] Filed: Dec. 14, 1987

[51] Int. Cl.[4] ..... E06C 1/383

[52] U.S. Cl. ..... 182/160; 182/220

[58] Field of Search ..... 182/160, 159, 162, 172, 182/220, 215

[56] References Cited

U.S. PATENT DOCUMENTS

| | | | |
|---|---|---|---|
| 256,990 | 4/1882 | Fish | 182/160 |
| 646,987 | 4/1900 | Herrick | 182/160 |
| 804,494 | 11/1905 | O'Hearne | 182/160 |
| 1,140,281 | 5/1915 | Otto | 182/160 |
| 1,401,526 | 12/1921 | Saussure | 182/160 |
| 1,631,922 | 6/1927 | Curtis | 182/160 |
| 3,901,354 | 8/1975 | Grebausky | 182/172 |

*Primary Examiner*—Reinaldo P. Machado
*Attorney, Agent, or Firm*—Henderson & Sturm

[57] ABSTRACT

A folding ladder of the type made up of a pair of side rails to which rungs are pivoted at opposite ends for folding of the structure from an open mode, in which the rungs are horizontal, to a closed or folded mode in which the rails move lengthwise relative to each other as well as toward each other as the rungs pivot about their respective pivots, parallel-link fashion. The present improvement resides in the design of each rail in semi-circular section in which the open side of the C thus formed faces inwardly toward the open side of the C of the other rail, whereby, in the closed mode, the two rails form a cylindrical shell within which the rungs are housed or confined, leading to a compact package that is easily carried, shipped, etc.

3 Claims, 3 Drawing Sheets

FOLDING LADDER

BACKGROUND AND SUMMARY OF THE INVENTION

Folding ladders of the general type referred to are known in the art but these lack such attributes as light weight, inexpensive design and construction, and foldability into an easy-to-carry compact "package." The present invention furnishes these attributes in a novel manner, achieved mainly by the provision of symmetrical rails that complement each other in closed mode to house the rungs in what may be termed a closed shell. A further feature of the invention is the provision of a plurality of bearing blocks attached to and received within the C-shaped rails and providing pivots for the ends of the rungs. The pivots themselves are arranged so as to be flush with the outer surface of the respective rail, thus avoiding projections that could snag or hang up during use or carrying. Another feature is that end portions of the rails are so designed as to cooperate with each other during closed mode so as to complete the cylindrical shape from end to end of the folded structure. Still further, certain portions of the rails provide stops for certain of the rungs in the open mode of the ladder.

Further features and advantages of the invention will become apparent from the ensuing description and accompanying drawings.

DETAILED DESCRIPTION OF A PREFERRED EMBODIMENT OF THE INVENTION

Figure 2:
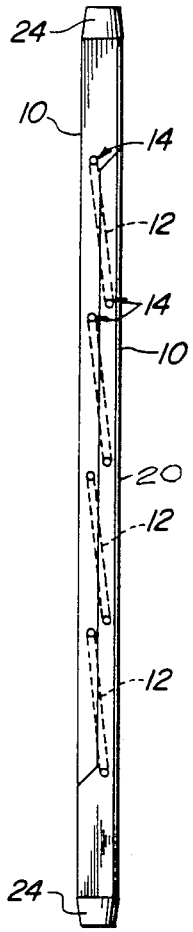
FIG. 2 is an elevation of the ladder in its closed mode.
Figure 1:
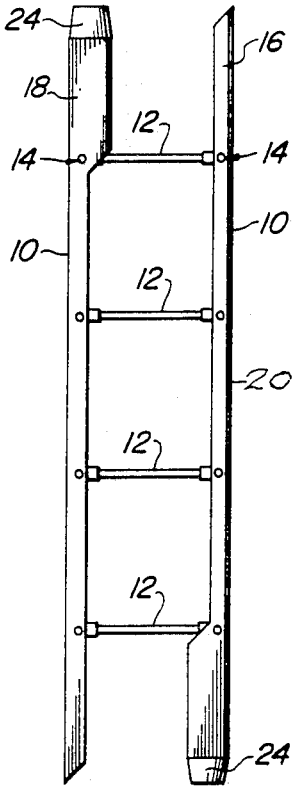
FIG. 1 is an elevation of the ladder in its open mode.

Reference will be had first to FIGS. 1 and 2 for an overview of the invention ladder, where the numeral (10) designates upright side rails joined by a plurality of rungs (12) pivoted at (14) at their ends to the side rails for operation of the ladder selectively between the open mode of FIG. 1 and the folded or closed mode of FIG. 2. It will be clear that the parts move parallel-link fashion in changing from open to closed modes and vice versa; that is to say, one rail moves vertically as it moves toward the other rail so that the structure is longer in its folded or closed mode than it is in its open or usable mode. This is typical of folding ladders of this general type.

Figure 3:
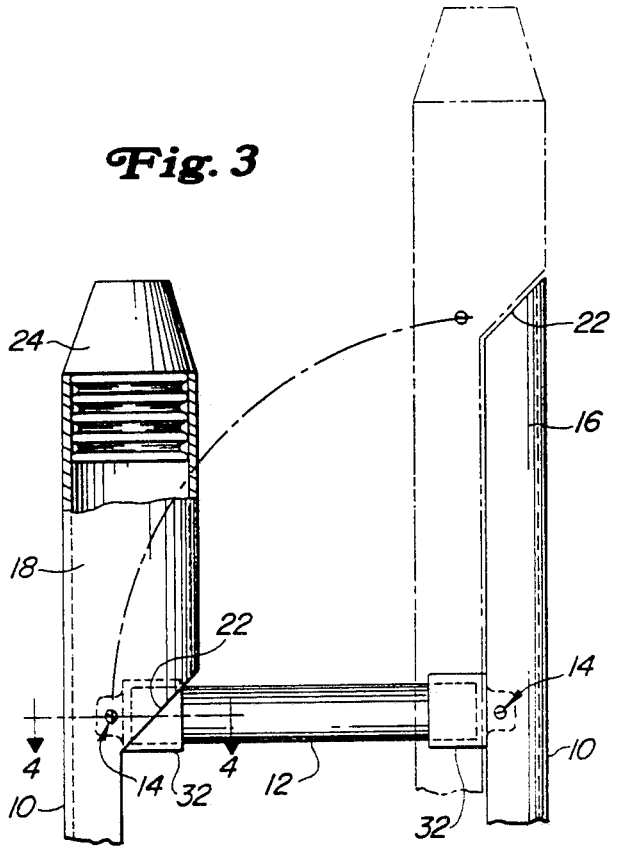
FIG. 3 is a fragmentary elevation, on an enlarged scale, showing details of construction.
Figure 5:
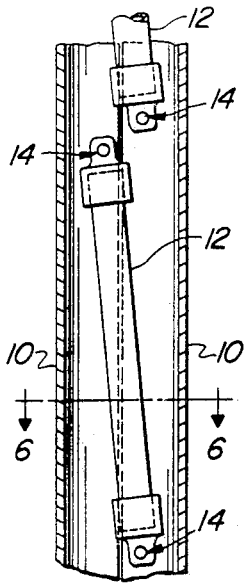
FIG. 5 is a section through the intermediate portion of the structure in closed mode, showing how the rungs are housed within the rails.
Figure 6:
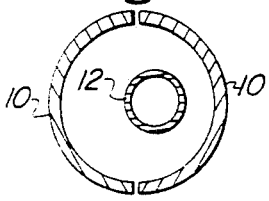
FIG. 6 is a section on the line 6—6 of FIG. 5.

The several parts of the ladder are formed of sturdy, light-weight and inexpensive material, including such materials as aluminum, fiber glass and other materials known for their excellent weight-to-strength characteristics. Each side rail is of essentially one-piece and may be of aluminum, having opposite end portions (16) and (18) and an intermediate portion (20) all integrally formed. Considering the right-hand rail as seen in FIGS. 1 and 2, the portions (16) and (20) are formed of semi-circular section, giving those portions a C-shaped form as seen in plan, while the lower end portion (18) is of cylindrical section of the same diameter as the portions (16) and (20). Since the two rails are symmetrical, the same design holds true for the left-hand rail, except that the cylindrical section occurs in the top portion. The two rails have the same length but when they are shifted relative to each other in moving to the FIG. 2 mode, the overall length of the package increases by about the length of a cylindrical portion (18). Each rail is provided at its inner side with a slope or bevel (22), here on the order of forty-five degrees, and these match up or interfit when the rails are nested in their closed mode. It should be noted that one slope on each rail occurs at the junction of a semi-cylindrical portion with a cylindrical portion and thus serves as stop means for the proximate rung in the open position of the ladder, as best seen in FIG. 3, full lines between the top rung and the left rail. A symmetrical stop means occurs also at the bottom part of the opposite rail. The design is such that, in the closed mode, the semi-cylindrical portions of the rails complement each other and form a closed cylindrical shell housing the folded rungs therewithin (FIGS. 5 and 6). The complete cylindrical portions form coaxial extensions of the complementing semi-cylindrical portions and thus create a compact package with the rungs concealed and housed. To complete the package, as well as to supplement the ladder in its open mode, the terminal ends of the cylindrical portions (18) are plugged with truncated conical elements (24), which may be of non-skid elastomer material of any suitable type. FIG. 3 best shows the manner in which a plug may be installed, using appropriate adhesive, for example. These plugs may have outward configurations of any form.

Figure 4:
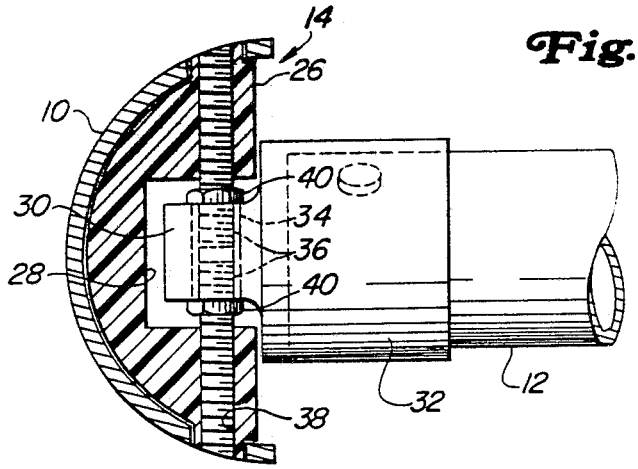
FIG. 4 is a partial section on the line 4—4 of FIG. 3.

FIG. 4 best shows one form of bearing block (26) used in forming the rung pivots. This block may be of any suitable material, preferably plastic or the like having the appropriate semi-cylindrical form to fit within the rail. The attachment of each block may be by way of a snap-in design and/or suitable adhesive. As seen, the block has an intermediate gap (28) for receiving an apertured ear (30) on a cap (32) affixed to the proximate end of the associated rung (12). The ear is lined with an interiorily threaded bushing (34) into which threaded rods (36) are threaded from opposite sides of the rail through the block (26) which is formed with a bore (38) for that purpose. The outer ends of the rods may be formed with tool-receiving means such as screw driver slots (not shown) for turning the rods in. Jam nuts (40) are used to prevent loosening of the rods during use of the ladder.

Figure 9:
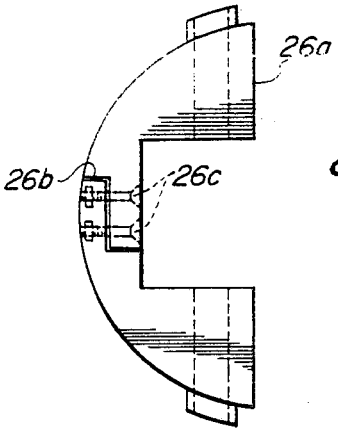
FIG. 9 is a plan view of a modified form of rung bearing.

FIG. 9 shows an alternate form of bearing block **(26*a*) of two piece construction having overlapping portions (26*b*) joined by bolts (26*c*). This form of block may be used in situations in which the block (26) is unsuitable; e.g., where the block (26)** will not snap in.

Figure 7:
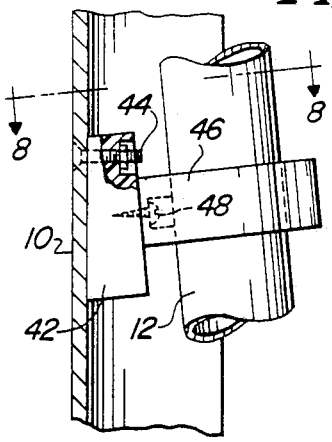
FIG. 7 is a fragmentary section showing releasable means for holding the ladder in its closed mode.
Figure 8:
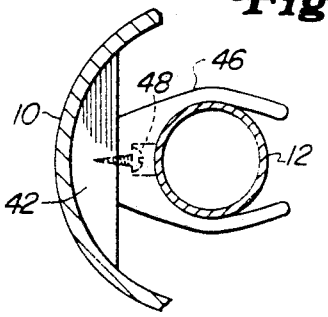
FIG. 8 is a section on the line 8—8 of FIG. 7.

FIGS. 7 and 8 show one form of releasable means that may be employed to retain the ladder in its closed mode. One of these means may be provided at each end of the ladder if desired. A block (42) is affixed to the interior of one rail as by one or more bolts (44), and a U-shaped clip (46) is fastened to this block as by a screw (48). The clip may be formed of spring steel, for example, shaped to grasp the proximate rung when the ladder is closed. The strength of the clip may be so designed as to retain the closed mode of the assembly but may yield to a pull adequate to move the rung out of the clip.

It will be clear from the foregoing that the novel ladder is possessed of many features, including light weight, strength, portability, ease of converting from one mode to the other and, especially in the closed mode, a smooth, attractive package that may be conveniently carried, stored, shipped, etc. Features and advantages other than those pointed out will be readily apparent to those versed in the art, as will many modifications and alterations of the preferred form of the invention herein disclosed, all without departure from the spirit and scope of the invention.

I claim:

1. A folding ladder having a pair of upright, parallel side rails and a plurality of cross rungs, each rung having horizontal pivots at its opposite ends hinging the rung respectively to the rails so as to enable the rails and rungs to function selectively in an open mode with the rails spaced apart and the rungs disposed horizontally or in a closed mode with the rails shifted vertically and swung closely together about the rung pivots to dispose the rungs in acutely angled relation to the rails, characterized in that each rail includes a top portion, a lower portion and an intermediate portion and at least the intermediate portion has a substantially semi-circular transverse section giving that portion the shape of a C as seen in plan, the rails being symmetrical and with the open sides of the Cs facing toward each other, each rung is a rigid element and the rung pivots and opposite ends of the rungs lie within the bight of the C, whereby, in the closed mode the intermediate portions of the rails complement each other to form a vertically elongated, hollow substantially cylindrical closed shell enclosing the rungs there within each rung pivot comprises a bearing block of semi-cylindrical section configured to nest within its associated rail, said block further having a gap therein facing the opposite rail, the proximate end of the end of the associated rung is received within the gap, a cross pin is carried by the block and passes through the received end of said rung and each rail having horizontally alined holes respectively coaxial with each cross pin and each block has coaxial portions projecting respectively into the associated holes.

2. A folding ladder as in claim 1, further characterized in that each rung end includes an end cap through which the associated cross pin passes and the rung is fitted into the cap.

3. A folding ladder as in claim 1, further characterized in that the top portion of one rail and the lower portion of the other rail are of cylindrical section having the same diameter as the semi-circular section, the bottom portion of said one rail and the top portion of said other rail have the same semi-cylindrical section as the intermediate rail portions whereby, in the closed mode, the top and lower portions nest together to give the closed ladder a cylindrical section from end to end, and the terminal end of each portion of cylindrical section includes a closure plug and each plug is of elastomer material having an inner end of cylindrical section tightly fitting the associated rail portion of cylindrical section and an integral outer portion projecting beyond said rail portion.

* * * * *